US007174617B2

(12) United States Patent
Wright

(10) Patent No.: US 7,174,617 B2
(45) Date of Patent: Feb. 13, 2007

(54) ACCORDION FENCING SYSTEM

(76) Inventor: Stephen G. Wright, 967 Birnam Woods Trail, Indianapolis, IN (US) 46280

( * ) Notice: Subject to any disclaimer, the term of this patent is extended or adjusted under 35 U.S.C. 154(b) by 247 days.

(21) Appl. No.: 10/940,565

(22) Filed: Sep. 14, 2004

(65) Prior Publication Data

US 2006/0054877 A1 Mar. 16, 2006

(51) Int. Cl.
*B23P 11/00* (2006.01)
*B23P 19/02* (2006.01)
*E04H 17/00* (2006.01)

(52) U.S. Cl. ..... 29/428; 29/525; 29/525.01; 256/1; 256/26; 256/73

(58) Field of Classification Search ..... 29/428, 29/436, 525, 525.01; 256/1, 26, 73, DIG. 2
See application file for complete search history.

(56) References Cited

U.S. PATENT DOCUMENTS

| | | | | |
|---|---|---|---|---|
| 38,108 | A * | 4/1863 | Haynes | 256/26 |
| 1,276,100 | A | 8/1918 | Niznik | |
| 2,011,528 | A * | 8/1935 | Seay | 256/26 |
| 3,347,527 | A | 10/1967 | Andrews | |
| 3,724,527 | A | 4/1973 | Johan | |
| 4,111,399 | A | 9/1978 | Hutchison, III | |
| 4,605,204 | A | 8/1986 | Schmanki et al. | |
| 4,838,525 | A | 6/1989 | Snow et al. | |
| 5,029,819 | A | 7/1991 | Kane | |
| 5,100,108 | A * | 3/1992 | Schultz | 256/24 |
| 5,282,606 | A * | 2/1994 | Praiss | 256/26 |
| 5,402,988 | A | 4/1995 | Eisele | |
| 5,704,592 | A | 1/1998 | White et al. | |
| 5,967,089 | A | 10/1999 | Allen | |
| 6,053,665 | A | 4/2000 | Richardson | |
| 6,098,750 | A | 8/2000 | Reynolds et al. | |
| 6,176,471 | B1 | 1/2001 | Naegele et al. | |
| 6,685,172 | B2 | 2/2004 | Jolliffe | |
| 2003/0146426 | A1 | 8/2003 | Ray et al. | |
| 2003/0197165 | A1 * | 10/2003 | Perelli | 256/26 |

FOREIGN PATENT DOCUMENTS

| | | | |
|---|---|---|---|
| GB | 2267722 | A * | 12/1993 |
| JP | 06146758 | A * | 5/1994 |

* cited by examiner

*Primary Examiner*—Jermie E. Cozart
(74) *Attorney, Agent, or Firm*—Krieg DeVault LLP

(57) ABSTRACT

A fencing system that includes a plurality of interconnected accordion-style fence segments is disclosed. The accordion-style fence segments include a plurality of slats having a predetermined width, a predetermined height, and a predetermined thickness. A plurality of supple folding zones interconnect respective adjacent slats. The supple folding zones have a second predetermined thickness. The plurality of supple folding zones are operable to allow the plurality of slats to fold in an accordion fashion such that the plurality of slats stack on top of one another to form a compact storage arrangement, and wherein the plurality of slats are capable of being expanded to a predetermined length.

14 Claims, 11 Drawing Sheets

ACCORDION FENCING SYSTEM

BACKGROUND OF THE INVENTION

1. Technical Field

The present invention relates generally to fences, and more particularly, to an outdoor accordion fencing system that is capable of being erected and taken down with minimal effort and positioned in a compact storage state for storage when not in use.

2. Related Art

Several different types of fences exist that are used in a wide variety of applications. Some of the common types of fences are chain link fences, wooden fences, vinyl fences or iron fences. Fences can also come in several different designs or shapes, such as a privacy fence or a picket fence. Chain link fences typically come in segments having a predetermined length. The segments of chain link fence come rolled up and may be unrolled and then attached to posts. Since chain link fences are typically made from some type of metal, they are bulky, do not tend to roll up easily for storage, and take up a large amount of space. In addition, these types of fences tend to rust and wear over time and are not easy to replace once installed.

Wooden or vinyl fences are common and can be installed in various shapes and sizes. In order to install a wooden or vinyl fence, a plurality of pieces of wood or vinyl segments is typically purchased. The pieces of wood or vinyl segments are then connected to pieces of wood that are connected horizontally between a pair of posts. As readily apparent, it takes a considerable amount of time and effort to install each section of fence. Once installed, these types of fences are typically not taken down because of the amount of effort that goes into their construction. Iron fences have most of the qualities of wooden or vinyl fences except the pieces that make up the fence are made from iron.

The problem with all known types of fences is that once erected, they are extremely difficult to take down. As a result, once the fence is installed, it is typically not taken down for several years. In addition, when installing these types of fences it takes a considerable amount of time and effort. Hundreds of pieces typically need to be connected together to create an entire fenced in area. Storing the materials needed to create these types of fences also takes up a considerable amount of space.

As a result of the aforementioned problems, a need exists for a fencing system that is capable of quickly being erected and taken down as well as conserving space when taken down and placed in storage.

SUMMARY

An illustrative embodiment of the present invention discloses an accordion fencing system that includes a plurality of accordion-style fence segments. The accordion-style fence segments come in predetermined lengths and may be connected to one another to enclose a predetermined amount of area. When not erected to form the fencing system, the accordion-style fence segments are operable to be positioned in a compact storage state. In order to create a portion of the fencing system, the accordion-style fence segments may be expanded, in an accordion-like manner, to a predetermined length.

The accordion-style fence segments include a plurality of slats that are interconnected to one another via at least one supple folding zone. The supple folding zones have a predetermined thickness that may be somewhat narrower than the thickness of the slats. This allows the slats to bend or stretch out from the compact storage state to the expanded state and vice versa. The supple folding zones are designed to be thick enough to allow the slats to bend without breakage of the supple folding zones. As such, the supple folding zones allow the slats to be expanded out in an accordion-like manner to create a segment of fence or folded up for storage.

The accordion-style fence segments may include a plurality of flexible support members. The flexible support members are capable of flexing between a relatively flat state in relation to the surface of the slats and a relatively perpendicular state in relation to the surface of the slats. A ground engaging post or spike may be positioned within an aperture of the flexible support members when in the perpendicular state to secure the accordion-style fence segment to the ground. The flexible support members allow the accordion-style fence segment to be anchored to the ground in an erect state.

End slats of the accordion-style fence segments may include at least one connection aperture. The connection apertures allow multiple accordion-style fence segments to be connected to one another. The accordion-style fence segments are connected together with a removable connector that fits within respective connection apertures of the accordion-style fence segments. As such, if, for example, someone needs to fence a fifty foot long section and each accordion-style fence segment expands into a ten foot section, five accordion-style fence segments may be connected together to obtain a fifty foot long section.

The accordion fencing system may also include an accordion-style gate that may be connected between respective accordion-style fence segments. The accordion-style gate may include a plurality of slats that are interconnected by a plurality of supple folding zones. As with the accordion-style fence segments, the accordion-style gate may be positioned in a compact storage state and an expanded state. However, when installed as part of the accordion fencing system, the accordion-style gate is not anchored to the ground at all points thereby allowing the gate to open and close.

Other systems, methods, features and advantages of the invention will be, or will become apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The components in the figures are not necessarily to scale, emphasis instead being placed upon illustrating the principles of the invention. Moreover, in the figures, like reference numerals designate corresponding parts throughout the different views.

DETAILED DESCRIPTION OF THE PRESENTLY PREFERRED EMBODIMENTS

Figure 1:
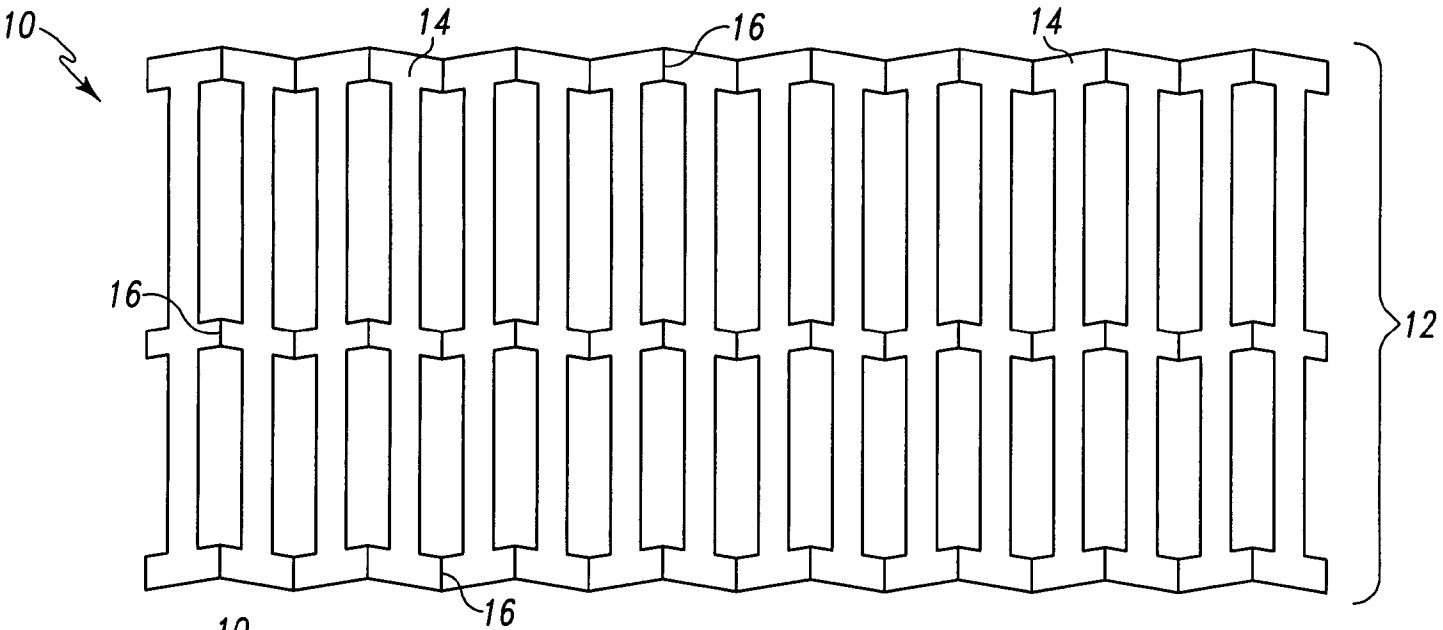
FIG. 1 illustrates an expanded front view of an accordion-style fence segment.

Referring to FIG. 1, a portion of an accordion fencing system 10 that includes at least one accordion-style fence segment 12, which is depicted in an expanded state, is illustrated. The accordion-style fence segment 12 is capable of being expanded to form a portion or segment of a fence or collapsed in a compact state for storage. Although not specifically illustrated in FIG. 1, as set forth in detail below a plurality of accordion-style fence segments 12 may be temporarily or permanently interconnected to form the accordion fencing system 10, which is designed to enclose or fence in a predetermined amount of area.

Figure 2:
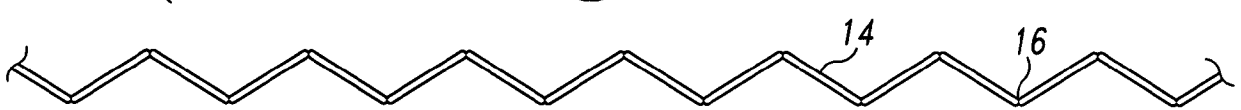
FIG. 2 illustrates a top view of a section of the expanded accordion-style fence segment depicted in FIG. 1.

As illustrated in FIGS. 1 and 2, the accordion-style fence segment 12 includes a plurality of vertical slats 14 that are formed having a predetermined width, a predetermined height, a predetermined thickness and a predetermined shape. The slats 14 are interconnected to each other by a plurality of supple folding zones 16 to thereby form the accordion-style fence segment 12. The supple folding zones 16 have a predetermined thickness that may be somewhat narrower than the thickness of the slats 14. This allows the slats 14 to be bent from a compact storage state to an expanded state and vice versa. The supple folding zones 16 are designed to be thick enough to allow the slats 14 to bend without breakage of the supple folding zones 16.

Figure 3:
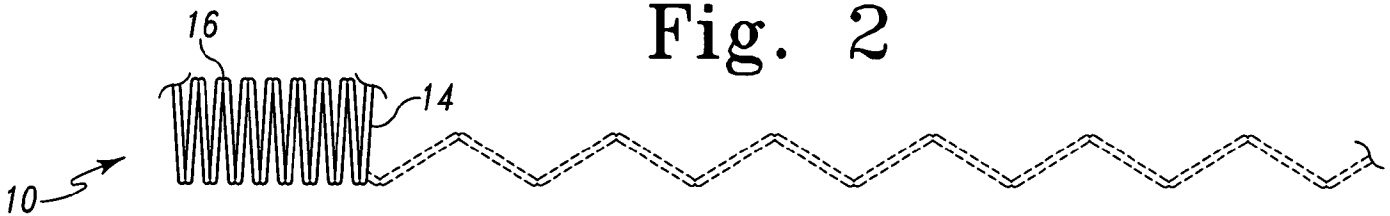
FIG. 3 illustrates a collapsed top view of the accordion-style fence segment depicted in FIG. 2.

Referring to FIG. 3, as set forth above the supple folding zones 16 allow the slats 14 to be folded in an accordion manner or fashion such that the slats 14 stack on top of one another in an alternating arrangement so that each accordion-style fence segment 12 may be positioned in a compact storage state. Referring back to FIGS. 1 and 2, the plurality of slats 14 are also capable of being expanded to form an accordion-style fence segment 12 having a predetermined length. As such, the accordion-style fence segment 12 is capable of being folded into a compact storage state and expanded to form a segment or portion of the accordion fencing system 10. Each accordion-style fence segment 12 may have a predetermined length, such as, by way of example only, a ten or twenty foot section of fence.

The accordion-style fence segment 12 may be manufactured using a polymer, such as polypropylene, but may also be manufactured from other materials having the same characteristics as polymers. The slats 14 may also be interconnected to one another using any material or mechanism that is capable of operating as a hinge. As such, although not illustrated, a plurality of hinge attachments may be connected with or manufactured as part of the slats 14. Although not illustrated, the slats 14 may also include a decorative design, such as, by way of example only, a seasonal decorative design for Christmas, Halloween or various other holidays. In addition, the slats 14 may be formed or molded in a variety of shapes, such as a honeycomb design, a traditional privacy fence design, a T-shaped design, an I-shaped design and so forth.

Figure 4:
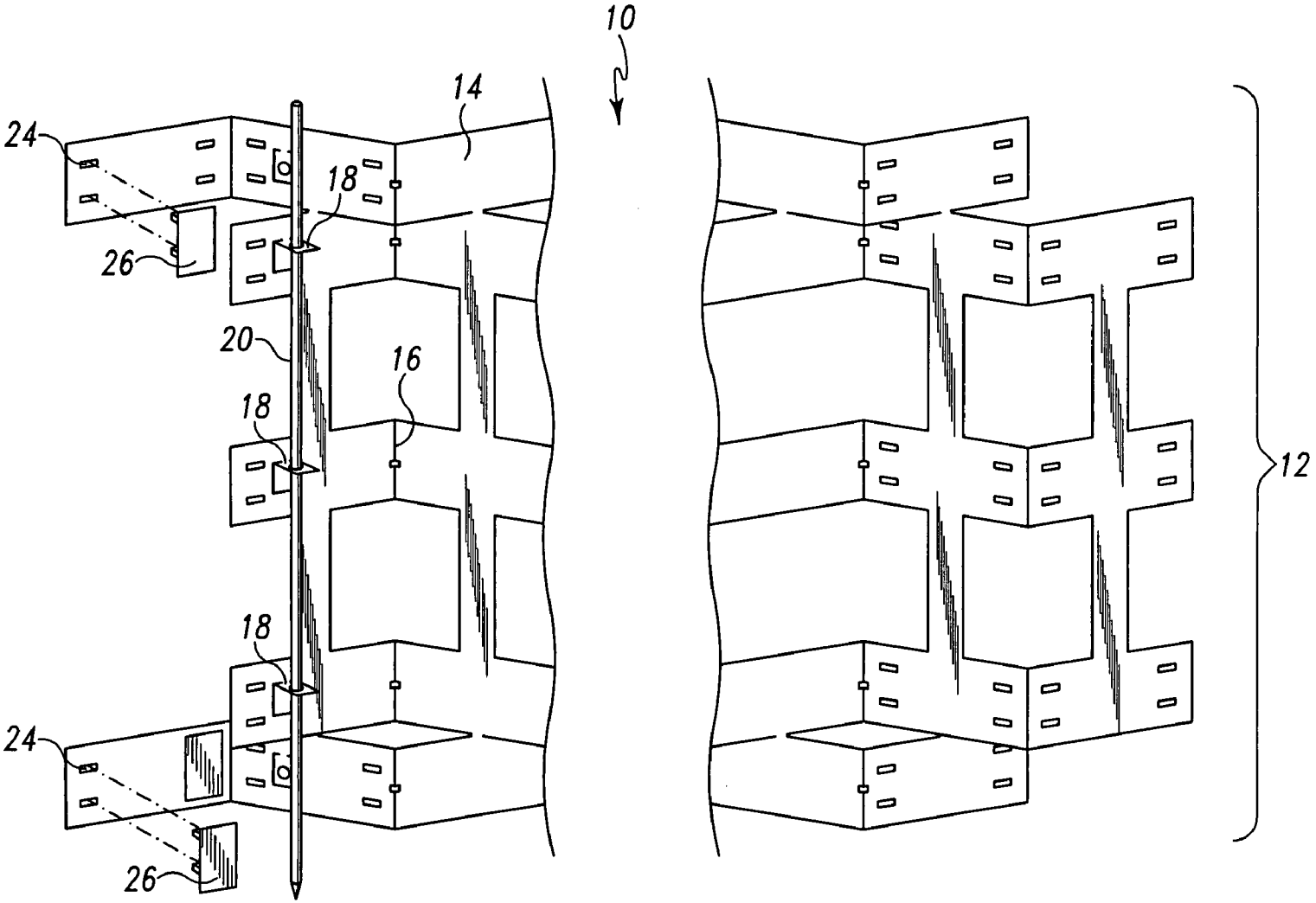
FIG. 4 illustrates end sections of an embodiment of the accordion-style fence segment.
Figure 6:
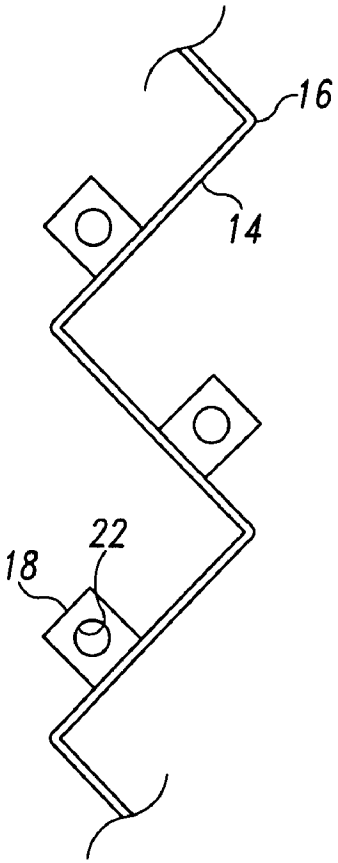
FIG. 6 is a top view of a portion of the accordion-style fence segment illustrating flexible support members.
Figure 5:
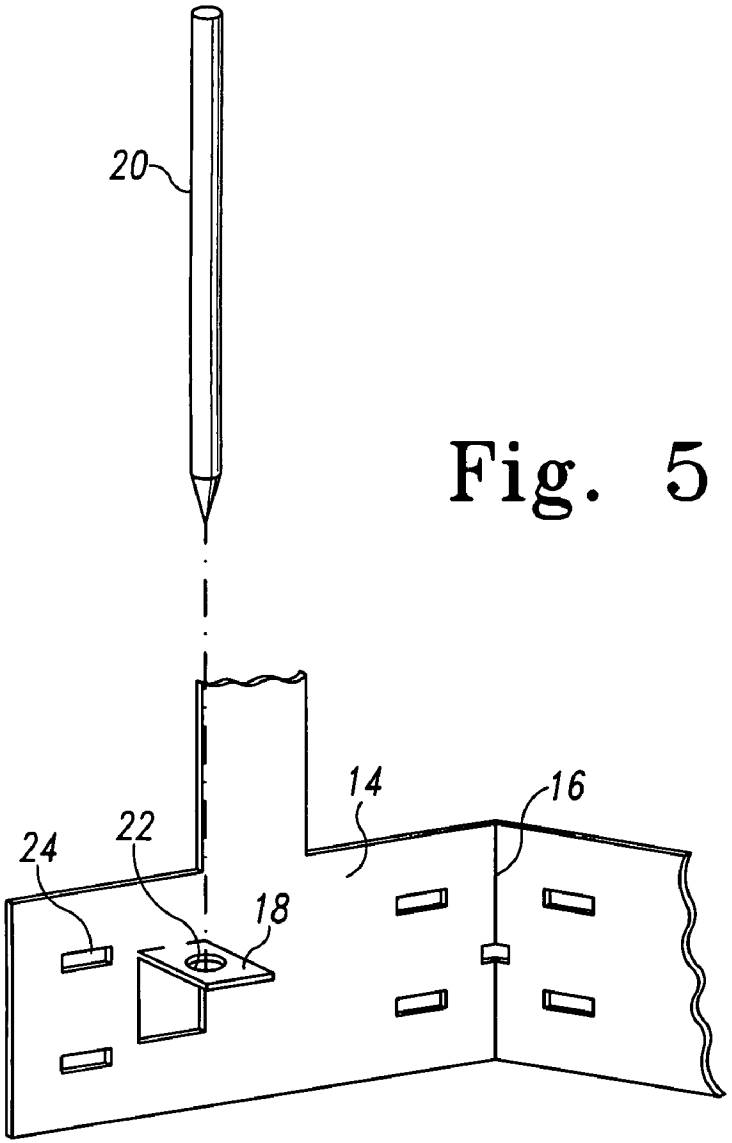
FIG. 5 illustrates a portion of an end section of the accordion-style fence segment illustrated in FIG. 4.

Referring to FIGS. 4–6, each accordion-style fence segment 12 of the accordion fencing system 10 may include at least one flexible support member 18. The flexible support members 18 may be positioned on the slats 14 such that they are aligned on a vertical axis in relation to the slats 14. In addition, the flexible support members 18 are capable of flexing or bending between a flat position in relation to the surface of the slats 14 and a perpendicular position in relation to the surface of the slats 14. The flexible support members 18 may be positioned flat when the accordion-style fence segment 12 is being stored and may be extended out when the accordion-style fence segment 12 is being used or has been erected. When extended out, the flexible support members 18 allow a ground-engaging post or spike 20 to be inserted in the flexible support members 18 so that each respective accordion-style fence segment 12 may be anchored to the ground in an upright or vertical position. The ground-engaging post or spike 20 may be inserted within apertures 22 located in the flexible support members 18.

Referring to FIGS. 4 and 5, the accordion-style fence segment 12 may also include a plurality of connection apertures 24 located in slats 14 that are at the respective ends of the accordion-style fence segment 12. The connection apertures 24 are designed to receive a connector 26 that is used to interconnect respective accordion-style fence segments 12 together to form the accordion fence system 10. As such, when the connection apertures 24 of the accordion-style fence segments 12 are aligned, the connector 26 is placed in the connection apertures 24 to secure the accordion-style fence segments 12 together.

Figure 7:
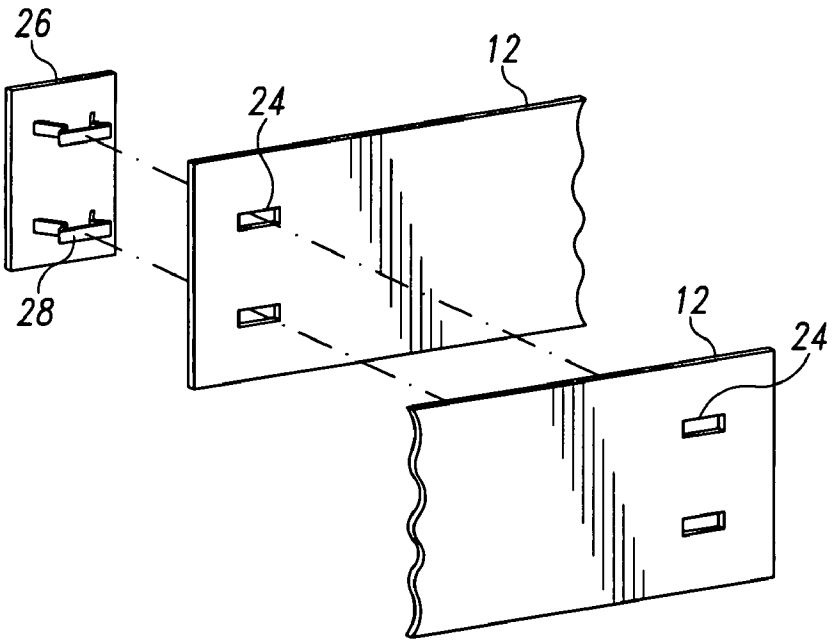
FIG. 7 illustrates portions of a pair of accordion-style fence segments aligned to be connected with one another with a clip.
Figure 8:
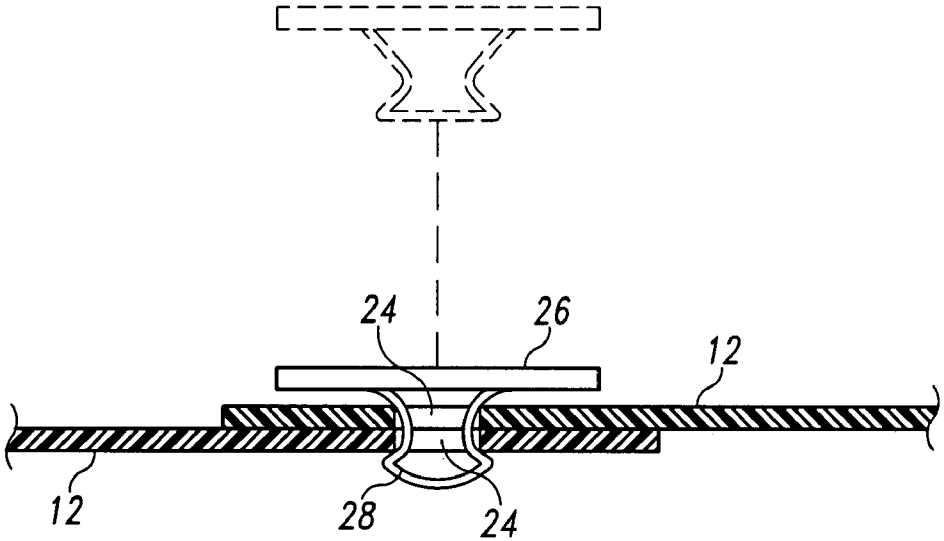
FIG. 8 is a cross-sectional top view of the accordion-style fence segments illustrated in FIG. 7 connected together with the clip.

As best illustrated in FIGS. 7 and 8, the connector 26 may be press or friction fit into the connection apertures 24 of respective accordion-style fence segments 12 to hold them together. The connectors 26 may include at least one link 28 that is designed to securely fit within the connection apertures 24 of the accordion-style fence segments 12. The connectors 26 are designed so that they may be easily removed when a user desires to take the accordion fence system 10 down for storage.

Figure 9:
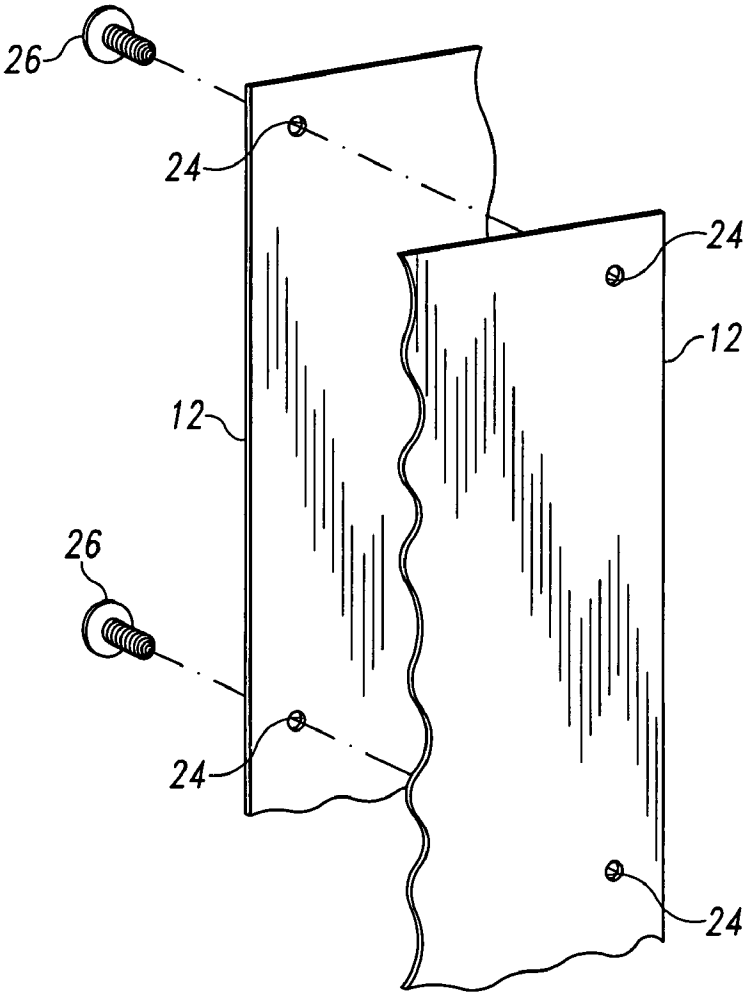
FIG. 9 illustrates portions of a pair of accordion-style fence segments aligned to be connected with one another with a friction fit screw.
Figure 10:
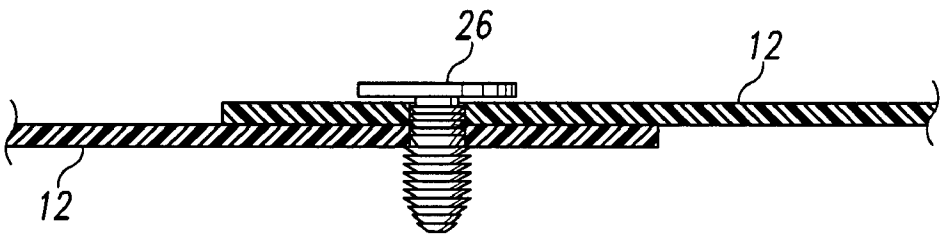
FIG. 10 is a cross-sectional top view of the accordion-style fence segments illustrated in FIG. 9 connected together with the friction fit screw.

Referring to FIGS. 9 and 10, in another embodiment of the present invention, the connector 26 may comprise a friction fit screw. As with other embodiments, when respective ends of accordion-style fence segments 12 are aligned such that their connection apertures 24 are properly aligned, the connector 26 is press or friction fit inside the connection apertures 24 to secure the accordion-style fence segments 12 together. The connectors 26 disclosed herein are preferentially manufactured from a polymer, such as polypropylene, or any other suitable type of material.

Figure 11:
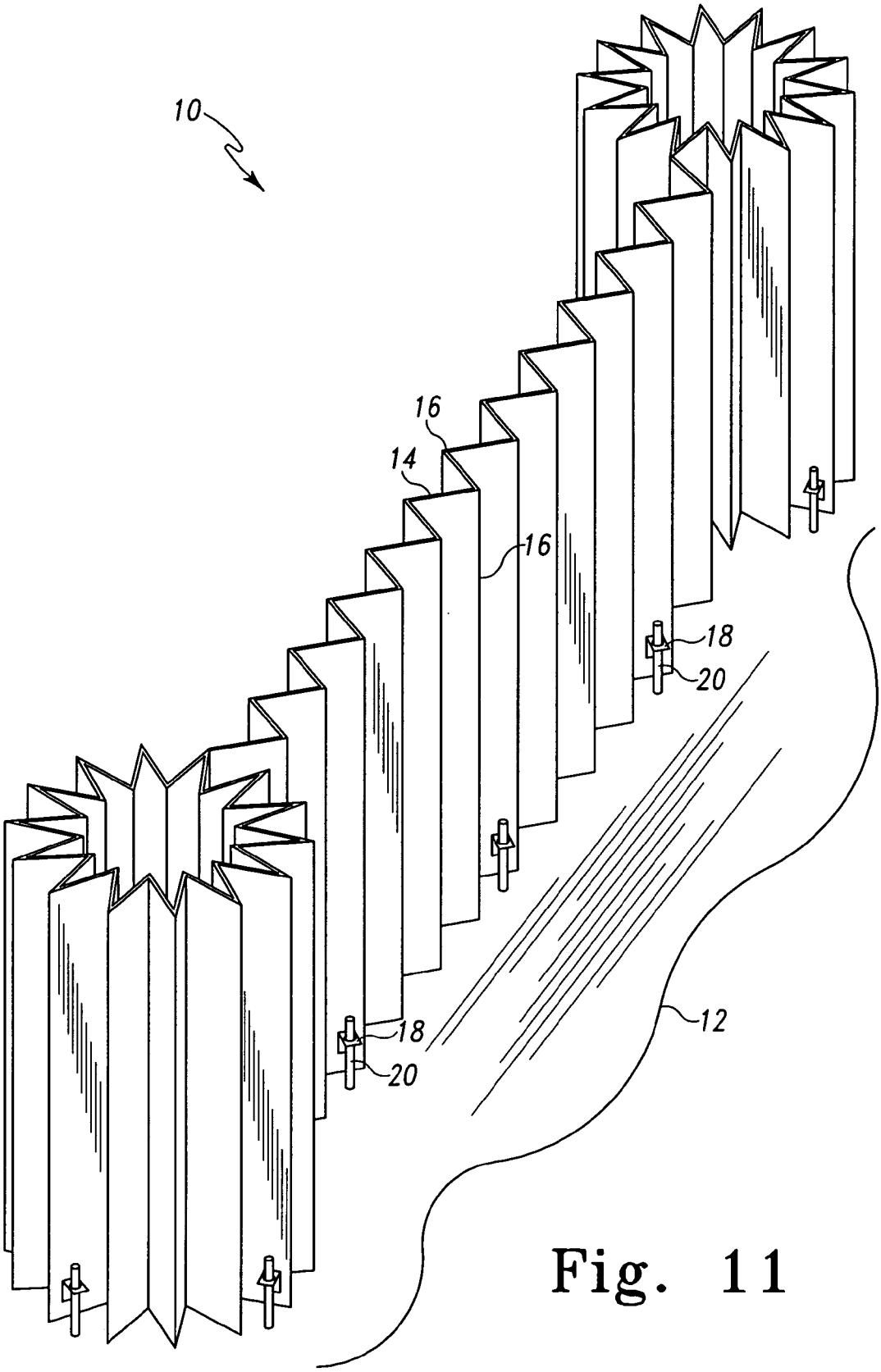
FIG. 11 illustrates an embodiment of an accordion-style fence segment secured to the ground.

Referring to FIG. 11, another embodiment of an accordion-style fence segment 12 of the accordion fencing system 10 is depicted in an erect state anchored to the ground. In this example, the accordion fencing system 10 is illustrated set up as a wind block or a temporary fence. As illustrated, the ground engaging spikes 20 are positioned within the flexible support members 18 to anchor the accordion-style fence segment 12 to the ground. As readily apparent, the accordion fencing system 10 may be erected and taken down quickly and easily. In this embodiment, the accordion-style fence segment 12 is capable of bending in many directions and at different angles. In addition, although not illustrated, the flexible support members 18 may be connected at the bottom or lower portion of the slats 14. The flexible support members 18 may include supple folding zones that allow the flexible support members 18 to fold or bend upward toward and rest on the slats 14 when in the compact storage state.

Figure 12:
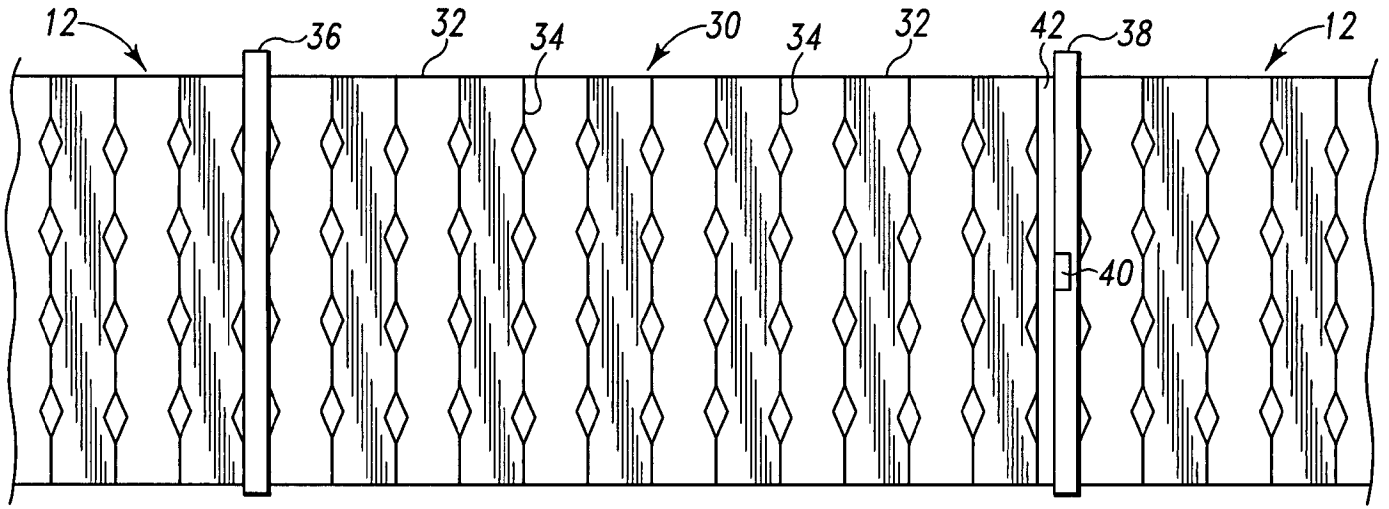
FIG. 12 illustrates an accordion-style gate connected to a pair of accordion-style fence segments in a shut position.
Figure 13:
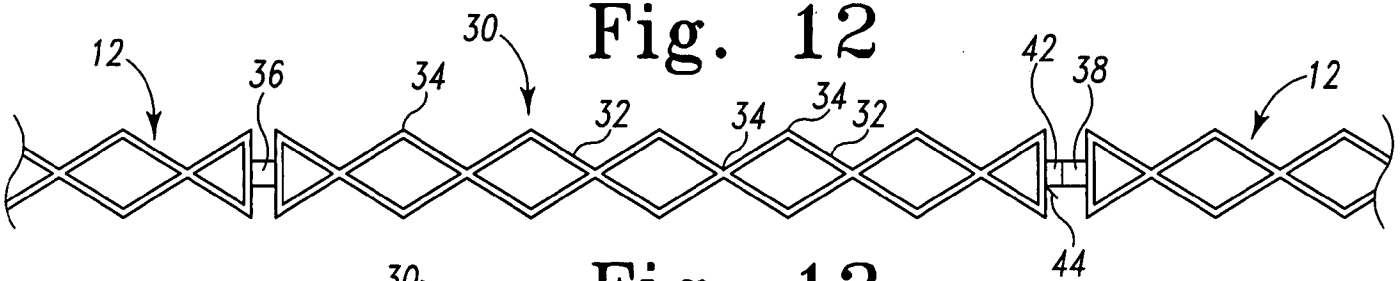
FIG. 13 is a top view of the accordion-style gate illustrated in FIG. 12.
Figure 14:
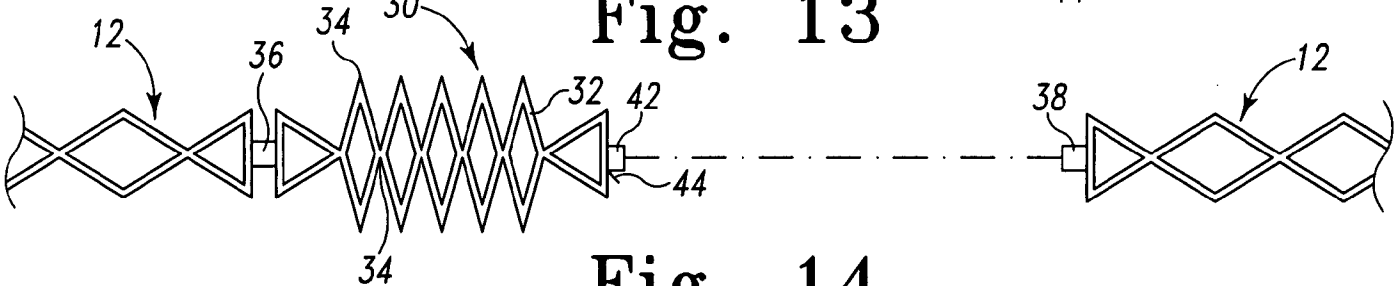
FIG. 14 is a top view of the accordion-style gate illustrated in FIG. 12 with the accordion-style gate in an open position.

Referring to FIGS. 12–14, the accordion fencing system 10 may also include an accordion-style gate 30. The accordion-style gate 30 may include a plurality of gate slats 32 that are interconnected by supple folding zones 34. The accordion-style gate 30 may include a first end post 36 and a second end post 38 that may be inserted or anchored to the ground, but does not have to be anchored to the ground. The first end post 36 may be connected with a respective gate slat 32 located on one end of the accordion-style gate 30 and one end of an accordion-style fence segment 12. The first end post 36 may be connected with the gate slat 32 and the accordion-style fence segment 12 using the connectors 26 disclosed herein. In addition, the accordion-style gate 30 may be connected with the first end post 36 using other connection devices commonly found in the art or may be formed as an integral molded piece of the accordion-style gate 30.

The second end post 38 of the accordion-style gate 30 may be connected with a respective end of another accordion-style fence segment 12. As with the first end post 36, the second end post 38 may be connected to the accordion-style fence segment 12 using the connectors 26 disclosed herein or any other type of conventional connection device commonly known in the art. In addition, the second end post 38 may be formed as an integral part of an accordion-style fence segment 12 that is specifically designed for the accordion-style gate 30. The second end post 38 may also include a recessed handle portion 40 that allows a user to place their hand within the recessed handle portion 40 to open the accordion-style gate 30.

Referring collectively to FIGS. 13 and 14, as illustrated the accordion-style gate 30 is operable to move between an open position and a closed position. The supple folding zones 34 allow the accordion-style gate 30 to move from a compact state to an expanded state in an accordion like manner or fashion. The accordion-style gate 30 may also include a support bracket 42 that may be connected with or formed as part of the accordion-style gate 30. Although not specifically illustrated, the support bracket 42 and the second end post 38 may include magnetic strips that are aligned to engage one another and temporarily secure the support bracket 42 with the second end post 38. The magnetic strips may keep the accordion-style gate 30 from opening inadvertently if wind is blowing for example. In addition, a handle 44 may be connected with the support bracket 42 that allows a user to easily open and shut the accordion-style gate 30. The accordion-style gate 30 may be adapted for use in various embodiments of the present invention.

Figure 15:
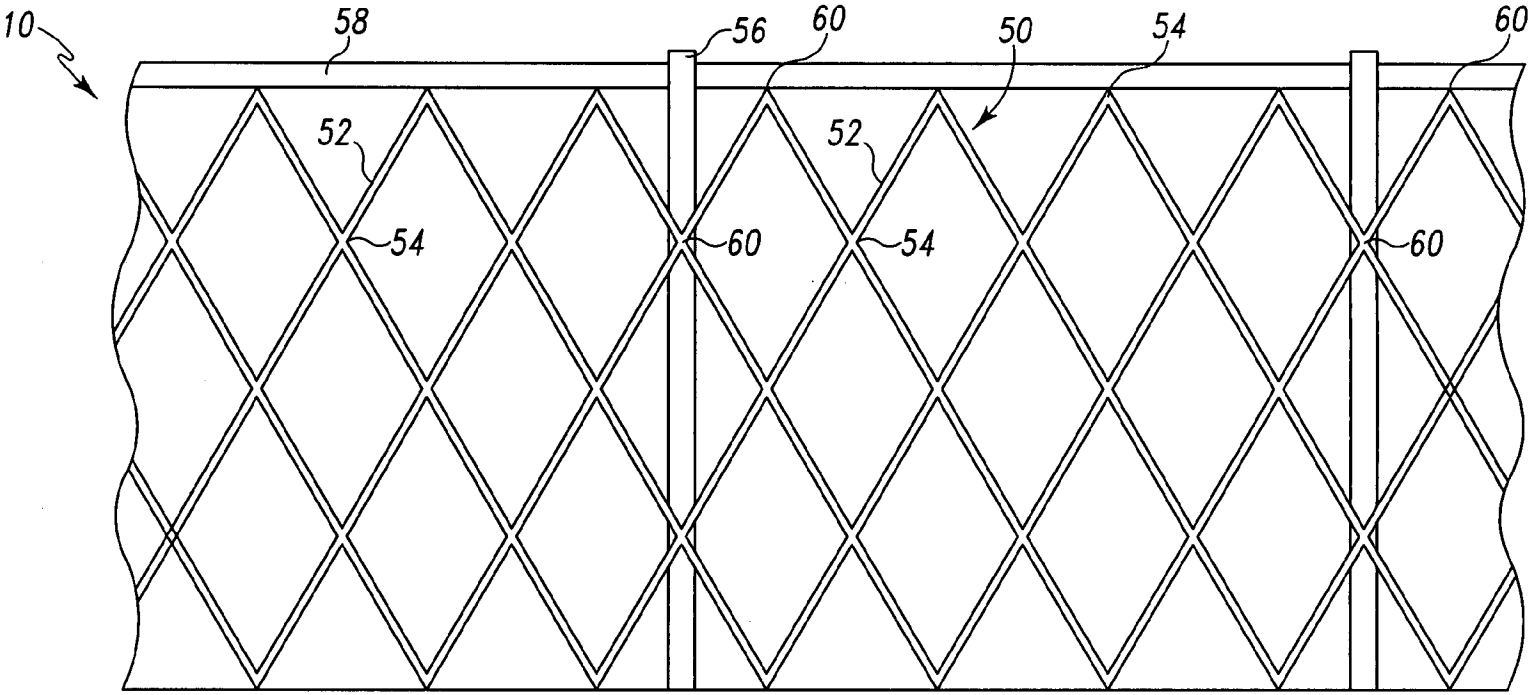
FIG. 15 illustrates a portion of a honeycomb or link accordion-style fence segment.
Figure 16:
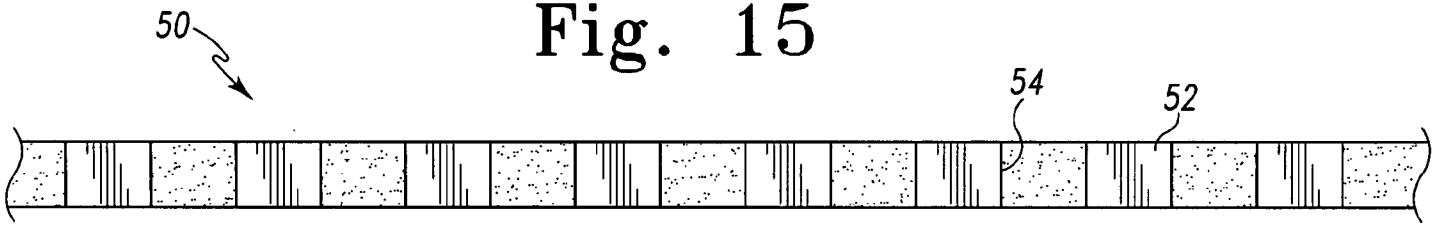
FIG. 16 is a top view of the honeycomb accordion-style fence segment illustrated in FIG. 15.
Figure 17:
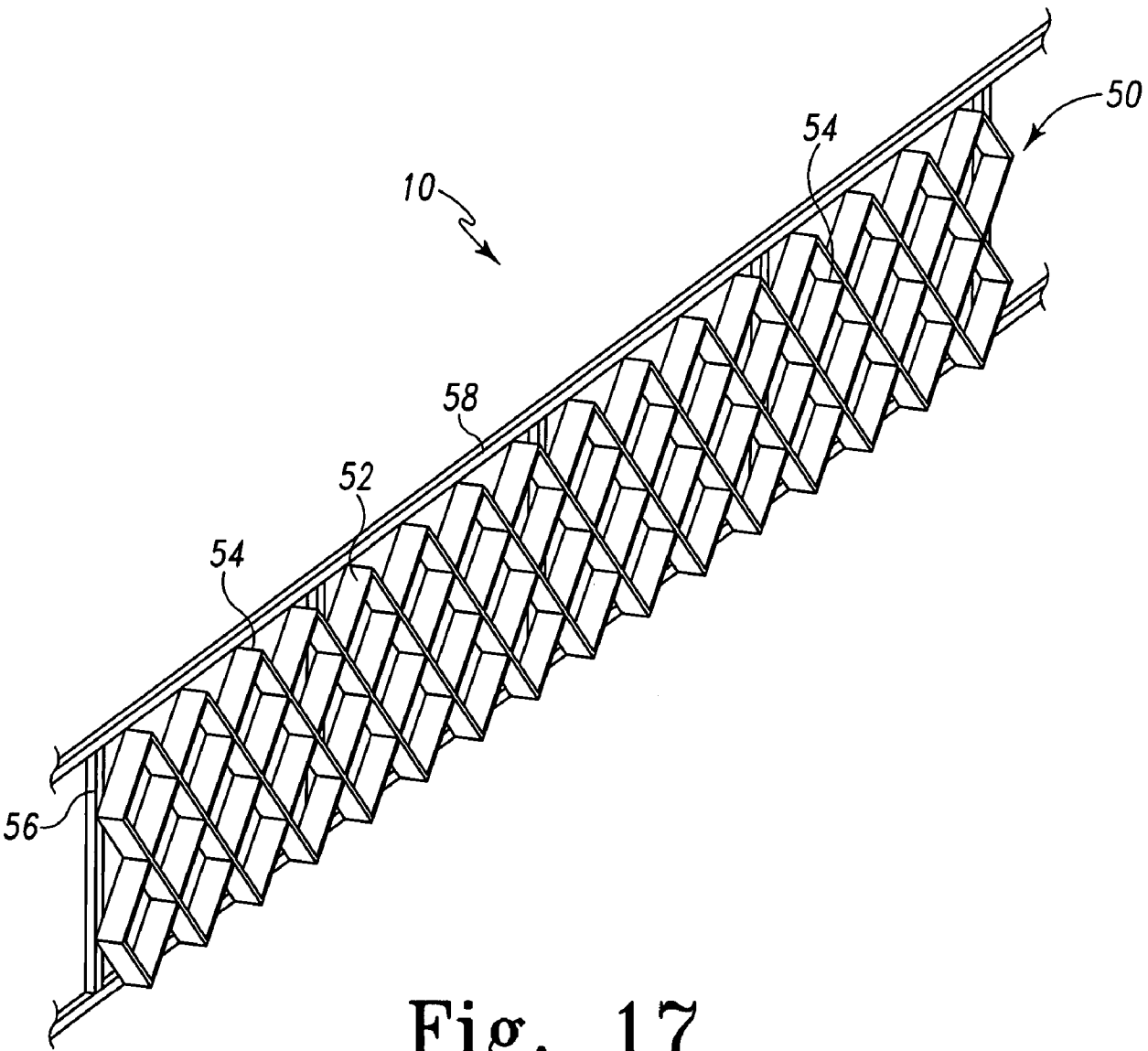
FIG. 17 is a perspective view of a portion of a honeycomb accordion-style fence segment.

Referring collectively to FIGS. 15–17, yet another embodiment of the present invention discloses a honeycomb or chain link accordion-style fence segment 50 that may be used in an accordion fencing system 10. The honeycomb accordion-style fence segment 50 may include a plurality of slats 52 that are interconnected with one another at supple folding zones 54. As with the previous embodiments, the honeycomb accordion-style fence segment 50 may be manufactured from any suitable polymer, such as polypropylene, or any other type of material that is capable of bending without breaking. Although not specifically illustrated, the honeycomb accordion-style fence segment 50 is operable to easily expand and contract between an expanded state and a compact storage state. As in other embodiments, the supple folding zones 54 allow the honeycomb accordion-style fence segment 50 to fold or contract so that the slats 52 stack on top of one another when in the storage state and extend outward when in the expanded state.

The accordion fencing system 10 illustrated in this embodiment may include a vertical support post 56 and a horizontal support post 58. The honeycomb accordion-style fence segment 50 may be connected with the vertical support post 56 or the horizontal support post 58 using any conventional connection device, such as, by way of example only, a tie or a clip. The honeycomb accordion-style fence segment 50 may be connected with the vertical support post 56 and the horizontal support post 58 at a plurality of attachment locations 60. The honeycomb accordion-style fence segment 50 includes a plurality of apertures 62 that allow people to see out and wind to pass through. While some embodiments of the invention may be designed as privacy fences, others may be designed as containment fences for animals and the like. The openings in the honeycomb accordion-style fence segment 50 allow wind to pass through the fencing system 10 and people to see in or out.

Figure 18:
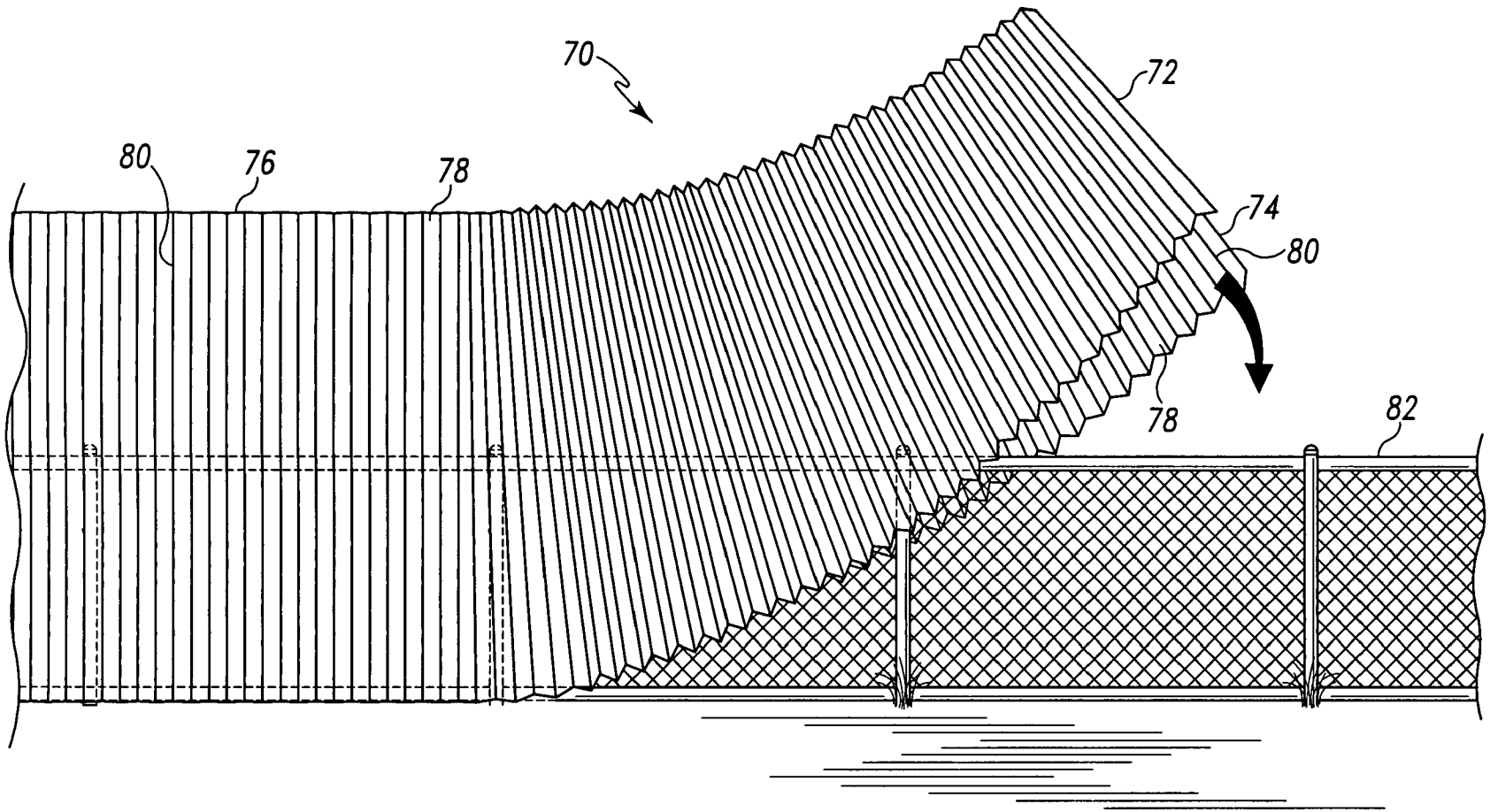
FIG. 18 illustrates a V-shaped accordion-style fence segment.

Referring to FIG. 18, yet another embodiment of the present invention discloses a V-shaped accordion-style fence segment 70. The V-shaped accordion-style fence segment 70 includes a first slat section 72 and a second slat section 74. The first slat section 72 and the second slat section 74 may be connected at an upper point 76 of the V-shaped accordion-style fence segment 70. As with other embodiments of the present invention, the first and second slat sections 72, 74 of the V-shaped accordion-style fence segment 70 include a plurality of slats 78 that are interconnected via a plurality of supple folding zones 80.

The V-shaped accordion-style fence segment 70 is operable to expand to form a portion of the accordion fencing system 10 and contract into a compact storage state when not in use. The V-shaped accordion-style fence segment 70 may be designed to fit over the top of an existing fence 82 or may be installed by itself. Although not illustrated, as in other embodiments of the present invention, the V-shaped accordion-style fence segment 70 may include a plurality of flexible support members 18 that are used, in conjunction with a ground engaging post or spike 20, to anchor the V-shaped accordion-style fence segment 70 to the ground. The V-shaped accordion-style fence segment 70 may be used to replace an unsightly existing fence 82 or may be erected as a complete fencing system 10. As with all of the embodiments of the present invention, the V-shaped accordion-style fence segment 70 may be used in conjunction with an accordion-style gate as well.

Figure 19:
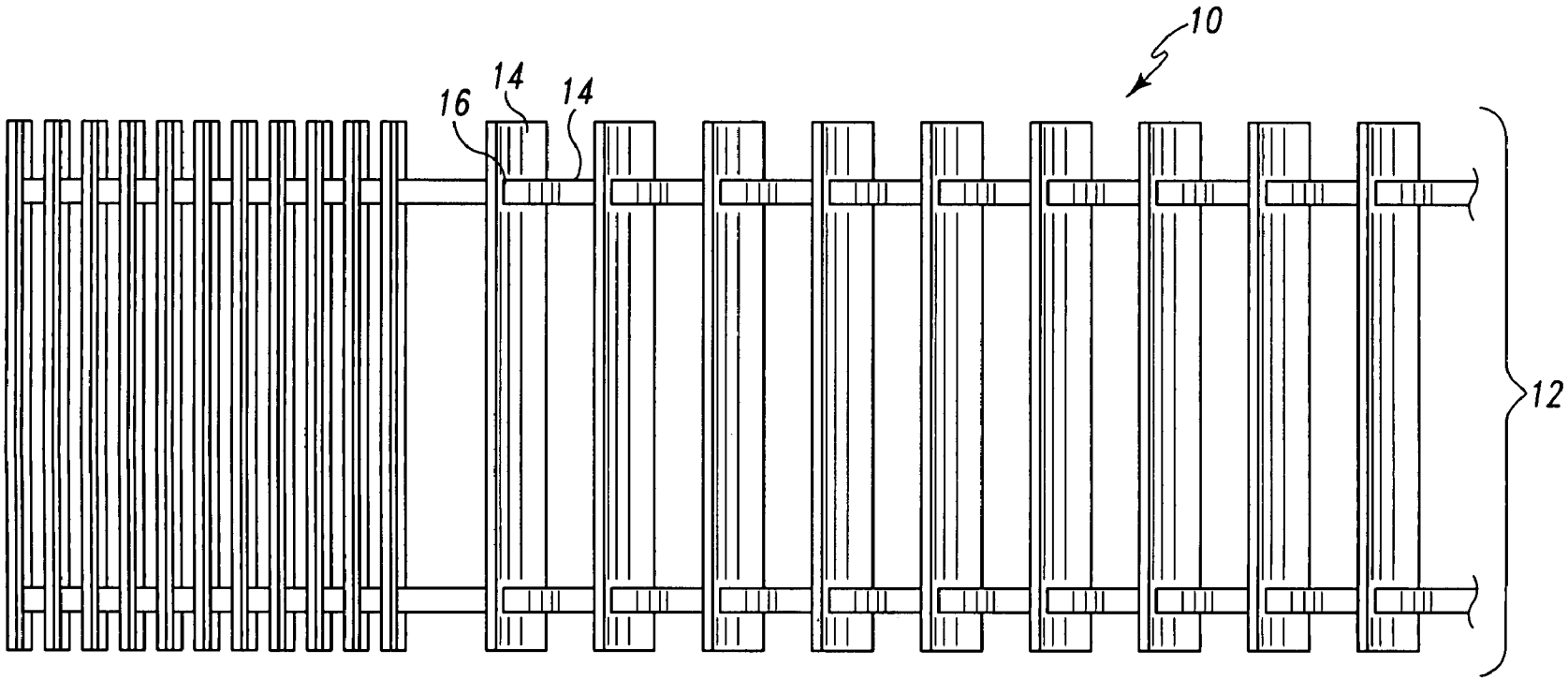
FIG. 19 illustrates another embodiment of an accordion-style fence segment.
Figure 20:
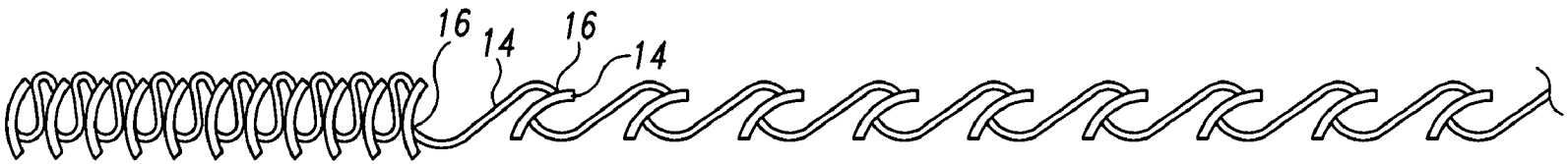
FIG. 20 is a top view of the accordion-style fence segment illustrated in FIG. 20.

FIGS. 19 and 20 are included to illustrate that the accordion-style fence segments 12 of the present invention may be manufactured having various shapes, sizes and designs. In any embodiment of the present invention, the accordion style fence segments 12 will include a plurality of slats 14 that are interconnected via a plurality of supple folding zones 16. The supple folding zones 16 allow the slats 14 to fold and stack on top of one another in a compact storage state and to be expanded out to form a portion of the accordion fencing system 10 in the expanded state. Those skilled in the art should recognize that the present invention may be manufactured in various sizes, shapes and designs.

As set forth in detail above, the present invention discloses an accordion fencing system 10 that allows people to quickly and easily enclose a predetermined amount of area, such as a backyard for example. To enclose the area, a plurality of accordion-style fence segments may be erected and connected to one another in a predetermined pattern. The accordion-style fence segments are taken from a compact state and expanded to an expanded state. An accordion-style gate may be included that allows people to enter and exit through an opening formed in the enclosure. When the accordion fencing system is ready to be taken down, the accordion-style fence segments are disconnected and placed in the compact state for storage.

While the present invention has been described with reference to specific exemplary embodiments, it will be evident that various modifications and changes may be made to these embodiments without departing from the broader spirit and scope of the invention as set forth in the claims. Accordingly, the specification and drawings are to be regarded in an illustrative rather than a restrictive sense.

What is claimed is:

1. A method of creating a fence, comprising:

providing a plurality of accordion-style fence segments operable to form a fencing section having a predetermined length, wherein each accordion fence segment includes a plurality of slats having a predetermined width, a predetermined height, and a predetermined thickness, wherein said accordion fence segment further includes a plurality of supple folding zones interconnecting respective adjacent slats such that said slats may be positioned on top of one another in a compact storage state and expanded out to form the fencing section, and wherein a predetermined number of slats include at least one flexible support member;

expanding a predetermined number of said accordion-style fence segments to form a predetermined number of fencing sections;

attaching said predetermined number of said fencing sections together to form a fencing area, wherein respective end slats of the plurality of slats of said accordion-style fence segments include a means for connecting one fencing section with another fencing section; and securing said fencing sections in an erect state with a securing mechanism positioned in said flexible support member.

2. The process of claim 1, further comprising connecting an accordion-style gate between respective fencing sections.

3. The method of claim 1, wherein said securing mechanism comprises a post positioned in an aperture located in said at least one flexible support member.

4. The method of claim 1, wherein said securing mechanism comprises a stake positioned in an aperture located in said at least one flexible support member.

5. The method of claim 1, wherein said flexible support member is positioned at a lower end of a select number of slats, wherein said flexible support member includes an aperture, wherein said flexible support member is capable of moving between a planar position in relation to said end slats and a relatively perpendicular position in relation to said end slats, wherein said securing mechanism is positioned within said aperture.

6. The method of claim 1, wherein said means for connecting one fencing section to another respective fencing section comprises at least one aperture located in predetermined locations of an end slat of each respective fencing section such that apertures of said end slats are capable of being aligned so that a removable connector can be positioned within said apertures to secure said fencing sections together.

7. The method of claim 1, wherein said supple folding zones include a plurality of perforations.

8. A method of forming a fence, comprising the steps of:

expanding a first accordion-style fence segment to form a fence section having a predetermined length, wherein said accordion fence segment is capable of being positioned in a collapsed state and an expanded state, wherein said accordion fence segment includes a plurality of slats interconnected by a plurality of supple folding zones, wherein said supple folding zones allow said slats to move between said compact storage state and extended out in an accordion manner to create said fence section when in said expanded state, wherein a predetermined number of slats include at least one flexible support member that is capable of being positioned in a planar position in relation to said slats when said accordion-style fence segment is in said collapsed state and capable of being positioned in a relatively perpendicular state in relation to said slats when said accordion-style fence segment is in said expanded state;

securing said fence section in place with a securing mechanism and said at least one flexible support member;

expanding a predetermined number of additional accordion fence segments to form a predetermined number of additional fence sections; and connecting said fence sections together to form a fencing area, wherein end slats of said plurality of slats includes a means for connecting one fence section with another fence section to form said fencing area.

9. The method of claim 8, further comprising the step of attaching an accordion-style gate between respective fence sections to provide an opening for said fencing area.

10. The method of claim 9, wherein said accordion-style gate is capable of being positioned between a closed state and an open state.

11. The method of claim 10, wherein the accordion gate includes a latching mechanism that is capable of keeping said accordion-style gate in said closed state.

12. The method of claim 8, wherein said means for connecting one fence section to another fence section comprises at least one aperture located in predetermined locations of said end slats of each respective fencing section such that said apertures of said end slats are aligned when said fencing sections are positioned in a vertical state in relation to one another, wherein a removable connector is positioned within said apertures to secure said fencing sections together.

13. The method of claim 12, wherein said removable connector comprises a friction fit clip.

14. The method of claim 12, wherein said removable connector comprises a friction fit screw.

* * * * *